United States Patent [19]

Skowronski

[11] Patent Number: 4,732,381

[45] Date of Patent: Mar. 22, 1988

[54] UPPER BODY ROTATION ASSEMBLY FOR A BACK TEST, REHABILITATION AND EXERCISE MACHIN

[75] Inventor: Richard E. Skowronski, West Sayville, N.Y.

[73] Assignee: Lumex, Inc., Bay Shore, N.Y.

[21] Appl. No.: 802,716

[22] Filed: Nov. 27, 1985

[51] Int. Cl.[4] ..... A63B 21/22

[52] U.S. Cl. ..... 272/134; 272/DIG. 4; 73/379

[58] Field of Search ..... 272/117, 118, 134, 143, 272/144, 93, DIG. 4, 69, DIG. 6, 97, 125; 73/379, 380; 297/486, 481, 483, 484, 47, 48, 487, 488; 128/774

[56] References Cited

U.S. PATENT DOCUMENTS

| | | | |
|---|---|---|---|
| 2,283,475 | 5/1942 | Wagner | 128/24 R |
| 2,791,999 | 5/1957 | Bustamante | 128/25 R |
| 3,722,951 | 3/1973 | Ezquerra | 297/487 X |
| 3,752,144 | 8/1973 | Weigle | 128/774 |
| 3,836,168 | 9/1974 | Nonaka | 297/487 X |
| 3,899,042 | 8/1975 | Bonar | 297/487 |
| 4,066,259 | 1/1978 | Brentham | 271/265 |
| 4,396,189 | 8/1983 | Jenkins | 272/97 |
| 4,456,245 | 6/1984 | Baldwin | 272/143 X |
| 4,462,252 | 7/1984 | Smidt | 272/DIG. 4 X |
| 4,492,236 | 1/1985 | Pile | 128/781 |
| 4,591,147 | 5/1986 | Smith et al. | 272/69 |
| 4,609,190 | 9/1986 | Brentham | 272/144 X |
| 4,655,506 | 4/1987 | Wise et al. | 297/488 X |

FOREIGN PATENT DOCUMENTS 2112653 7/1983 United Kingdom .

OTHER PUBLICATIONS

"Quantitative Assessment of Back Strength Using Isokinetic Testing", *Spine*, vol. 9, No. 3, 1984 (287–290).

Atlantic J., vol. 55, No. 4, Dec. 1974, pp. 15, 26, 28, 30, 31 and 77–80.

*Primary Examiner*—Richard J. Apley

*Assistant Examiner*—Howard Flaxman

*Attorney, Agent, or Firm*—Davis Hoxie Faithfull & Hapgood

[57] ABSTRACT

An upper body rotation assembly for a back test, rehabilitation and exercise machine designed for the isolated testing, rehabilitation and exercise of the lower back musculature of a person in rotation about a vertical axis is disclosed. The rotation assembly has a curved chest pad which bears against the chest of the person and a scapula pad which bears against the scapula of the person. The curve of the chest pad is designed to fit the greatest variety of upper body shapes and sizes, providing the greatest comfort and stabilization to the largest portion of the population possible. Two belts, one on each side of the rotation assembly, secure the chest pad to the scapula pad. The rotation assembly is attached to a frame of the machine such that when the person exerts a rotational force against the chest pad and the scapula pad the rotation assembly rotates relative to the frame of the machine. A handle is provided on the chest pad for the person to grab onto with his or her hands while exerting a rotational force against the chest pad and the scapula pad. An operator of the machine can align a natural anatomical axis of the upper body of the person with an axis of rotation of the rotation assembly by sliding the scapula pad backward and forward until the sagittal midline plane of the person is visually aligned with a bracket on the frame of the machine. The chest pad may be raised or lowered so that the person may easily enter or exit from the rotation assembly.

17 Claims, 8 Drawing Figures

UPPER BODY ROTATION ASSEMBLY FOR A BACK TEST, REHABILITATION AND EXERCISE MACHIN

FIELD OF THE INVENTION

This invention relates to an upper body rotation assembly for a back test, rehabilitation and exercise machine designed for the isolated testing, rehabilitation and exercise of the lower back musculature in rotation about a vertical axis.

BACKGROUND OF THE INVENTION

Medical personnel, such as orthopaedic physicians and physical therapists, have long sought an effective way to measure in isolation the strength of the musculature of a patient's lower back in rotation about a vertical axis. Medical personnel have also sought a machine which could be used for the rehabilitation of the musculature of a patient's lower back after surgery, a stroke or other illness, or an accident, whereby the patient could rotate his or her lower back musculature to its full strength capability and range of motion without danger of injury.

Also, employers who employ persons in job functions which require extensive rotational movement of the lower back musculature have long sought a way to screen potential employees for rotational strength deficiencies or rotational range of motion limitations. By testing the rotational strength of a potential employee's lower back musculature prior to assigning the person to the specified job function, the employer can determine whether the potential employee has the lower back musculature rotational strength and rotational range of motion needed for the job function. Such industrial screening is of value in keeping health insurance costs down by reducing the incidence of employee injuries, and is also of value by increasing work-force productivity.

In order to effectively measure in isolation the strength of the musculature of a patient's lower back in rotation about a vertical axis, it is necessary to prevent muscle groups in the patient's upper and lower body, other than those muscles in the lower back, from participating in the rotational movement during the test, rehabilitation or exercise procedure. These extraneous muscle groups, such as muscles in the pelvic area, legs, shoulders and arms, must be adequately stabilized if the rotational strength of the musculature in the lower back is to be effectively measured in isolation during the test, rehabilitation or exercise procedure. Also, the patient's lower back musculature range of rotational motion cannot be determined unless these extraneous muscle groups are prevented from taking part in the rotational movement.

Securing the upper and lower body of the patient by use of belts alone is not sufficient, because belts are not rigid enough to provide the degree of stabilization required. Further, the stabilization provided by belts alone is not reproducible, i.e., it cannot be guaranteed that the patient will be stabilized in the same way for each individual test, rehabilitation or exercise procedure. Further, stabilization by belts alone often causes discomfort or pain to the patient. Any major discomfort or pain to the patient during the test, rehabilitation or exercise procedure inhibits the patient in his or her rotational movement, producing inconsistent measurements of the strength of the musculature in the lower back and of the rotational range of motion.

SUMMARY OF THE INVENTION

The present invention is for an upper body rotation assembly for a back test, rehabilitation and exercise machine designed for the isolated testing, rehabilitation and exercise of the lower back musculature of a person in rotation about a vertical axis. The rotation assembly of the present invention has a curved chest pad which bears against the chest of the person. The curvature of the chest pad is designed to fit the greatest variety of upper body shapes and sizes, providing the greatest comfort and stabilization to the largest portion of the population possible. The rotation assembly also has a scapula pad which bears against the scapula of the person. The chest pad is attached to a front support structure which in turn is attached to a top support structure. The scapula pad is attached to a rear support structure which is also attached to the top support structure. The top support structure is attached to a slide assembly such that the top support structure may slide forward or backward in the slide assembly when two toggle clamps are in the unlocked position. The slide assembly is attached to a frame of the machine such that the rotation assembly will rotate relative to the frame of the machine when the person exerts a rotational force against the chest pad and the scapula pad.

The chest pad is secured to the scapula pad by two belts, one on each side of the rotation assembly. The chest pad also has attached to it a handle whereby the person, when exerting a rotational force against the chest pad and the scapula pad, may secure his or her arms against movement by grabbing the handle.

The chest pad and front support structure may be raised or lowered to allow the person to easily enter or exit from the rotation assembly. A gas spring attached at one end to the top support structure and at the other end to the front support structure keeps the chest pad and the front support structure in a raised position unless pulled down by an operator of the machine. The gas spring also keeps the chest pad lightly against the chest of the person when the chest pad and the front support structure are in the lowered position.

A bracket on the frame of the machine is used to align a vertical axis of rotation of the rotation assembly to a natural anatomical axis of the upper body of the person. To accomplish the alignment the operator slides the top support structure in the slide assembly until the sagittal midline plane of the person is visually aligned with a vertical line of the bracket. The operator places the toggle clamps in the locked position once the alignment is made, thus preventing the top support structure from sliding in the slide assembly.

The rotation assembly, except for a cushion portion of the chest pad and the scapula pad, is primarily made of aluminum and thin wall steel tubing to maximize stiffness and also to minimize the mass moment of inertia of the rotation assembly so that the person does not have to use much energy to accelerate the rotation assembly.

DETAILED DESCRIPTION OF THE INVENTION

Figure 1:
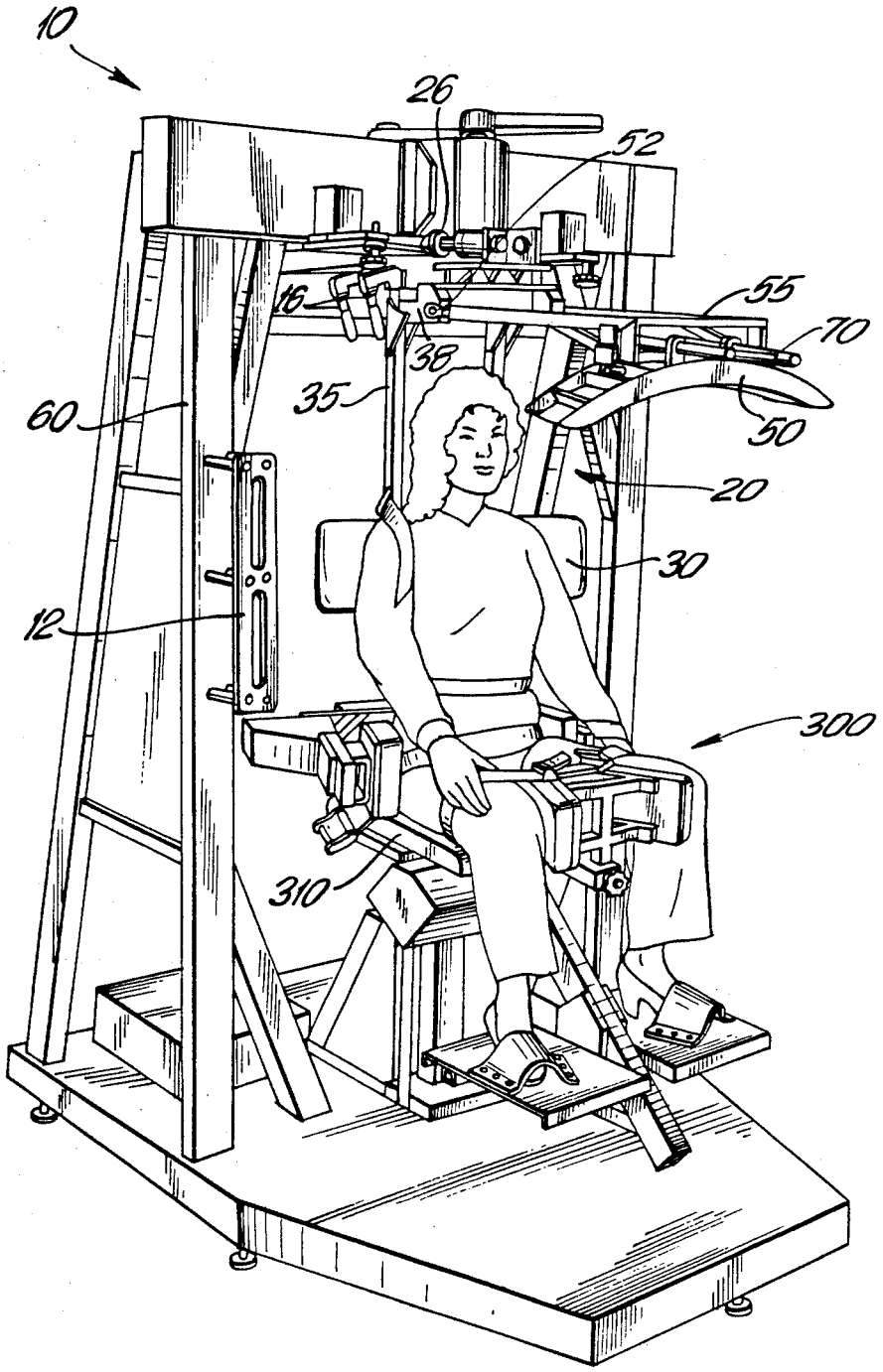
FIG. 1 is a perspective view of a back test, rehabilitation and exercise machine containing the upper body rotation assembly of the present invention, wherein a chest pad and a front support structure of an upper body rotation assembly of the present invention are in a raised position.
Figure 2:
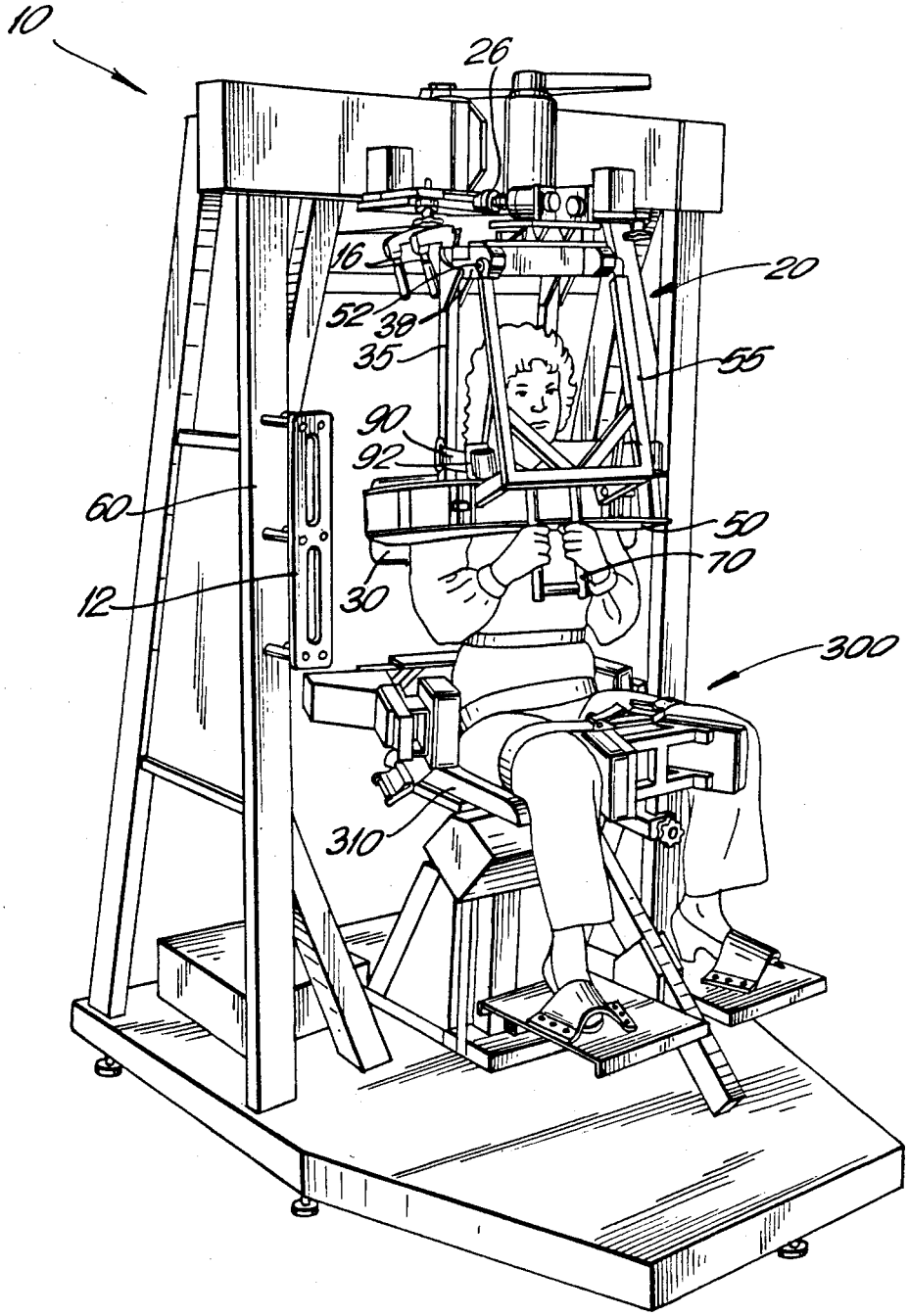
FIG. 2 is another perspective view of the back test, rehabilitation and exercise machine of FIG. 1 with a person secured in the machine and the chest pad and the front support structure of the upper body rotation assembly of the present invention in a lowered position.
Figure 2A:
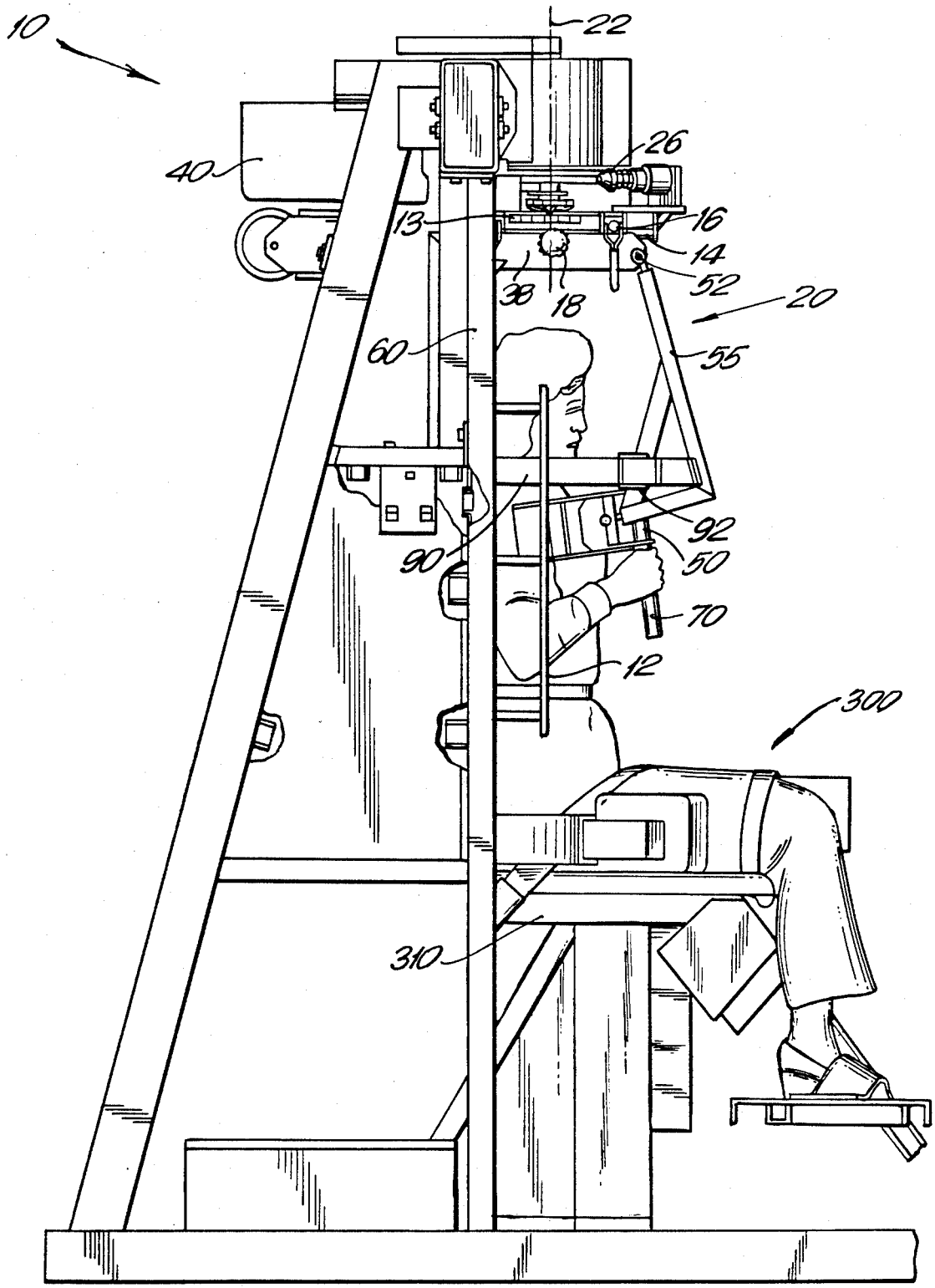
FIG. 2A is a side elevational view of the machine of FIG. 2.

A back test, rehabilitation and exercise machine 10 which contains an upper body rotation assembly 20 of the present invention is shown in FIGS. 1, 2 and 2A. The details of the upper body rotation assembly 20 are shown in FIGS. 3, 4, 5, 6 and 7.

The machine 10 is designed to measure the rotational strength of the lower back musculature of a patient without involvement in the rotation of muscle groups other than those muscles in the lower back. The measurement made by the machine 10 allows quantification of rotational strength and deficits throughout a patient's range of motion as the patient rotates his or her lower back musculature.

An isokinetic dynamometer 40, which is connected to the rotation assembly 20, measures the patient's strength as he or she tries to rotate against a chest pad 50 and a scapula pad 30, which are bearing against the chest and scapula of the patient, as described below. During the test, rehabilitation or exercise procedure, the pelvis, thighs and other leg muscles of the patient are stabilized against movement by a lower body stabilization apparatus 300 which is the subject of applicant's copending application entitled Lower Body Stabilization for a Back Test, Rehabilitation and Exercise Machine, filed concurrently with this application. The description of the lower body stabilization apparatus 300 contained in that application is incorporated herein by reference.

The isokinetic dynamometer 40, which provides resistance to the patient's rotation of the rotation assembly 20, is connected to the rotation assembly 20 by a mechanical connection (not shown). The dynamometer 40 operates on the well-known theory of isokinetics whereby the speed of rotation of the rotation assembly 20 cannot exceed a pre-determined limit. The pre-determined speed of rotation of the rotation assembly 20 is set by making a selection from dynamometer controls (not shown) on the dynamometer 40.

The general theory of isokinetics is described in U.S. Pat. No. 3,465,592 issued to J. J. Perrine on Sept. 9, 1969. The description of isokinetics contained in that patent is incorporated herein by reference.

Until such time as the patient exerts a force on the chest pad 50 and the scapula pad 30 sufficient to make the rotation assembly 20 rotate at the pre-determined speed, the patient will not feel any resistive force. However, any attempt by the patient to accelerate the rotation assembly 20 beyond the pre-determined speed results in the dynamometer 40 providing an accommodating, resistive force equal to the rotation force exerted by the patient. Therefore, the patient cannot make the rotation assembly 20 rotate any faster than the pre-determined speed, and any increased force exerted by the patient is met by an equal accommodating, resistive force from the dynamometer 40.

The isokinetic dynamometer 40 in the present embodiment is similar to the dynamometer which is available as part of the Cybex® II+ test, rehabilitation and exercise machine, which is manufactured and sold by the Cybex Division of Lumex Inc., 2100 Smithtown Ave. Ronkonkoma, N.Y.

Since the dynamometer 40 provides an accommodating, resistive force equal to the rotation force exerted by the patient, measurement of the force provided by dynamometer 40 is also a measurement of the rotational strength of the lower back musculature of the patient throughout the patient's range of rotational motion. A computer (not shown) can be used to record this measurement and process a group of measurements for further analysis of the patient's progress during the test, rehabilitation or exercise procedure.

The sequence for securing the patient in the machine 10 is described below in order to more fully illustrate and describe the structure and operation of the rotation assembly 20 of the present invention.

The patient is first seated in the machine 10 on a seat 310. A scapula pad 30 rests against the scapula of the patient when the patient sits on the seat 310 of the machine 10, as shown in FIG. 1.

Figure 4:
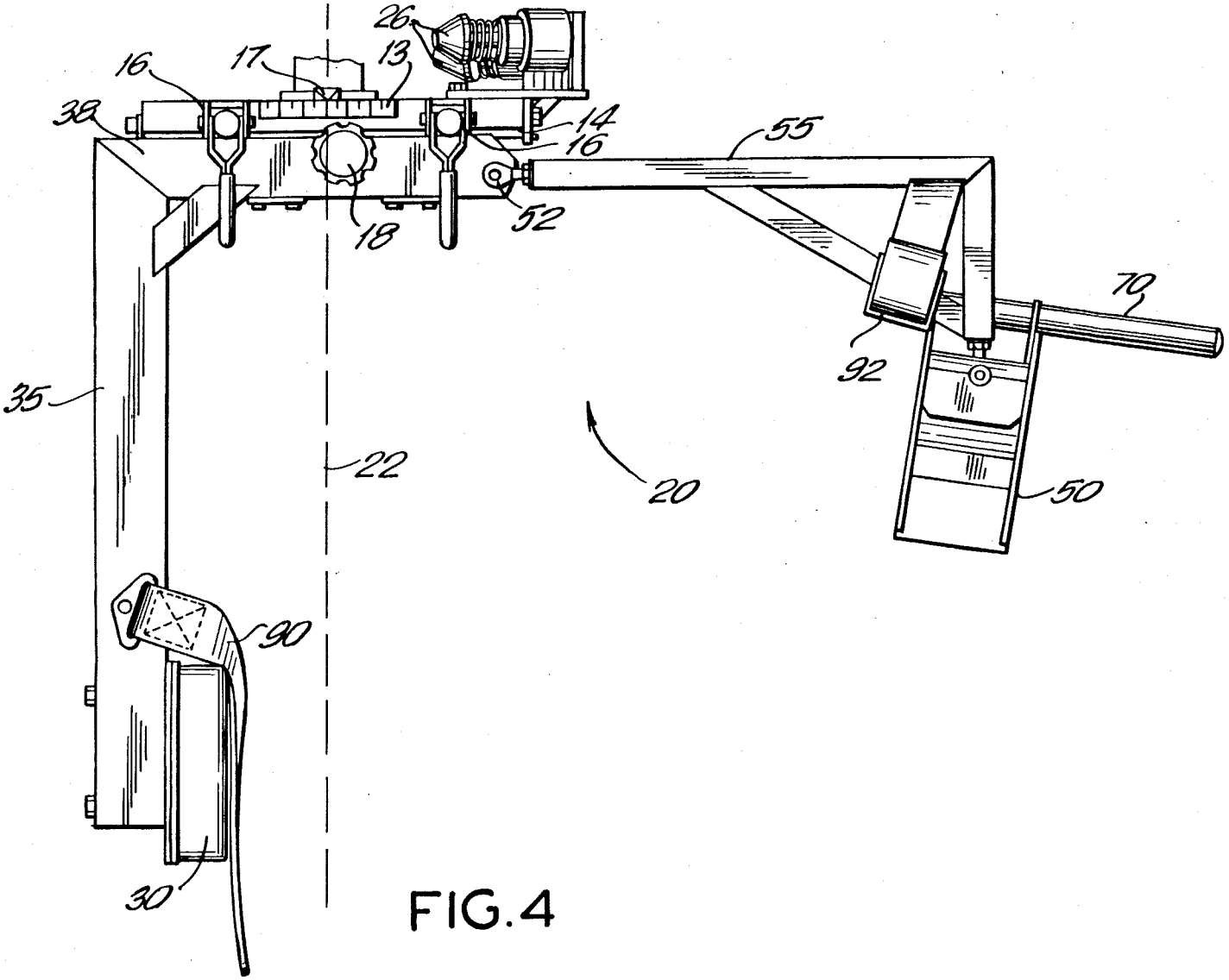
FIG. 4 is a side elevational view of the upper body rotation assembly of the present invention with the chest pad and the front support structure in the raised position.
Figure 5:
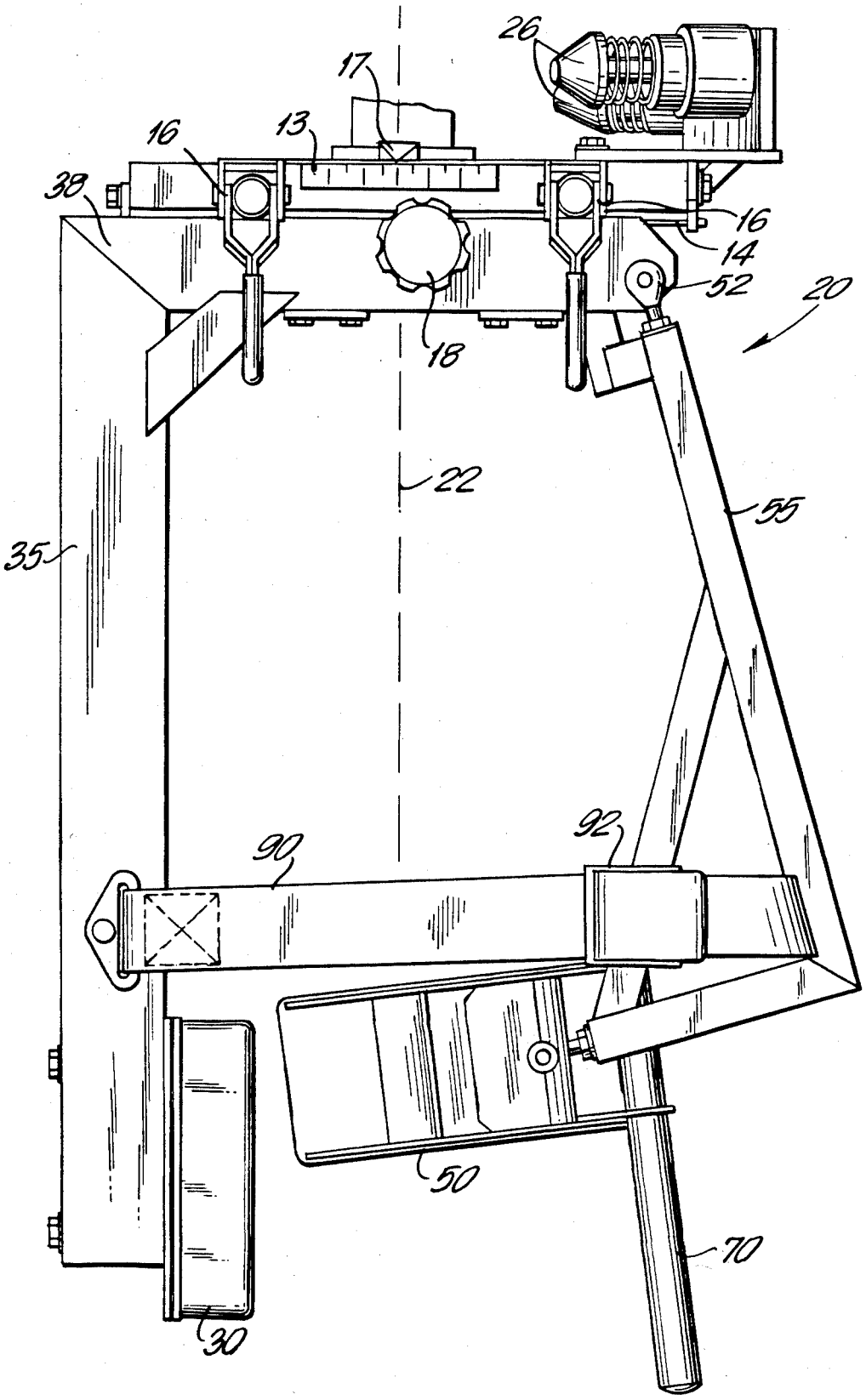
FIG. 5 is a side elevational view of the upper body rotation assembly of FIG. 3.

The scapula pad 30 is attached to a rear support structure 35 of the rotation assembly 20, as shown in FIGS. 4 and 5. The rear support structure 35 is attached to a top support structure 38 which in turn is attached to a slide assembly 14. The slide assembly 14 is attached to a frame 60 of the machine 10 in a manner which permits the entire rotation assembly 20 to rotate when the patient exerts a rotational force against the chest pad 50 and the scapula pad 30, as described below.

After the patient is seated on seat 310 of the machine 10, it is necessary to align the patient's natural anatomical axis with the vertical axis of rotation 22 of the rotation assembly 20. The vertical axis of rotation 22 of the rotation assembly 20 is represented by the dotted line 22 shown in FIGS. 4 and 5.

It is important to align the vertical axis of rotation 22 of the rotation assembly 20 and the patient's natural anatomical axis because rotation of the rotation assembly 20 in an axis different from the patient's natural anatomical axis causes the trunk of the patient to extend or flex. Such trunk extension or flexion results in misleading or erroneous measurement of the rotational strength of the lower back musculature in rotation about a vertical axis. Since, as previously described, the purpose of the machine 10 is to provide isolated testing, rehabilitation and exercise of the rotational strength of the lower back musculature about a vertical axis without involvement in the rotation of muscle groups other than those muscles in the lower back, misalignment of the vertical axis of rotation 22 of the rotation assembly 20 in relation to the natural anatomical axis of the patient must be avoided for the machine 10 to operate in a totally effective and safe manner. Also, rotation of the rotation assembly 20 in an axis different from the natural anatomical axis of the patient risks injury to the patient because of the simultaneous rotation of the trunk and extension of the trunk. The combination of simultaneous trunk rotation and trunk extension can cause injury to the lower back in some cases. Incidents of injury due to this problem are virtually eliminated during the operation of the machine 10 provided that the vertical axis of rotation 22 of the rotation assembly 20 is aligned with the natural anatomical axis of the patient.

The alignment of the upper part of the patient's natural anatomical axis, i.e., that part above the waist of the patient, is accomplished by sliding the top support structure 38 backward or forward in slide assembly 14 as required. The top support structure 38 may slide forward or backward in slide assembly 14 provided toggle clamps 16, which are attached to slide assembly 14, are in the unlocked position.

In the present embodiment, the operator of the machine 10 accomplishes the alignment of the upper part of the patient's natural anatomical axis with the axis of rotation 22 of the rotation assembly 20 by visual means. With the patient seated on the seat 310, and the scapula pad 30 resting against the scapula of the patient as previously described, and with the toggle clamps 16 in the unlocked position, the operator stands to one side of the machine 10 and slides the top support structure 38 of the rotation assembly 20 backward or forward as required until a bracket 12 on the frame 60 is in visual alignment with the sagittal midline plane of the patient. Bracket 12, which is best seen in FIG. 2A, is mounted on the frame 60 in alignment with the vertical axis of rotation 22 of the rotation assembly 20.

The operator slides the top support structure 38 by turning a knob 18. The knob 18 is attached to the top support structure 38 such that turning knob 18, when toggle clamps 16 are in the unlocked position, causes the top support structure 38 to slide forward or backward in slide assembly 14, depending on which direction knob 18 is turned.

Once the operator has completed this alignment procedure, the toggle clamps 16 are placed in the locked position. This locks the top support structure 38 at the desired position. The operator then can note the lateral position of the top support structure 35 by looking at a pointer 17 in relation to a position label 13, which is mounted on the slide assembly 14. This position information from position label 13 can be used again when the patient returns at a later time for further testing, rehabilitation or exercise. Also, the position information from position label 13 is useful for comparison with position information from other patients or against a standard value.

The lower part of the patient's natural anatomical axis, i.e., that part below the waist, is aligned with the vertical axis of rotation 22 of the rotation assembly 20 in the manner described in applicant's copending application entitled "Lower Body Stabilization for a Back Test, Rehabilitation and Exercise Machine, " which description is incorporated herein by reference.

After the natural anatomical axis of the patient is aligned with the axis of rotation 22 of rotation assembly 20, the lower body of the patient is secured to the machine 10 by use of the lower body stabilization apparatus 300 described in applicant's copending application "Lower Body Stabilization for a Back Test, Rehabilitation and Exercise Machine, " which description is also herein incorporated by reference.

Next, the operator secures the patient in the rotation assembly 20 by lowering the chest pad 50 over the chest of the patient, to the lowered position shown in FIGS. 2 and 2A.

Figure 3:
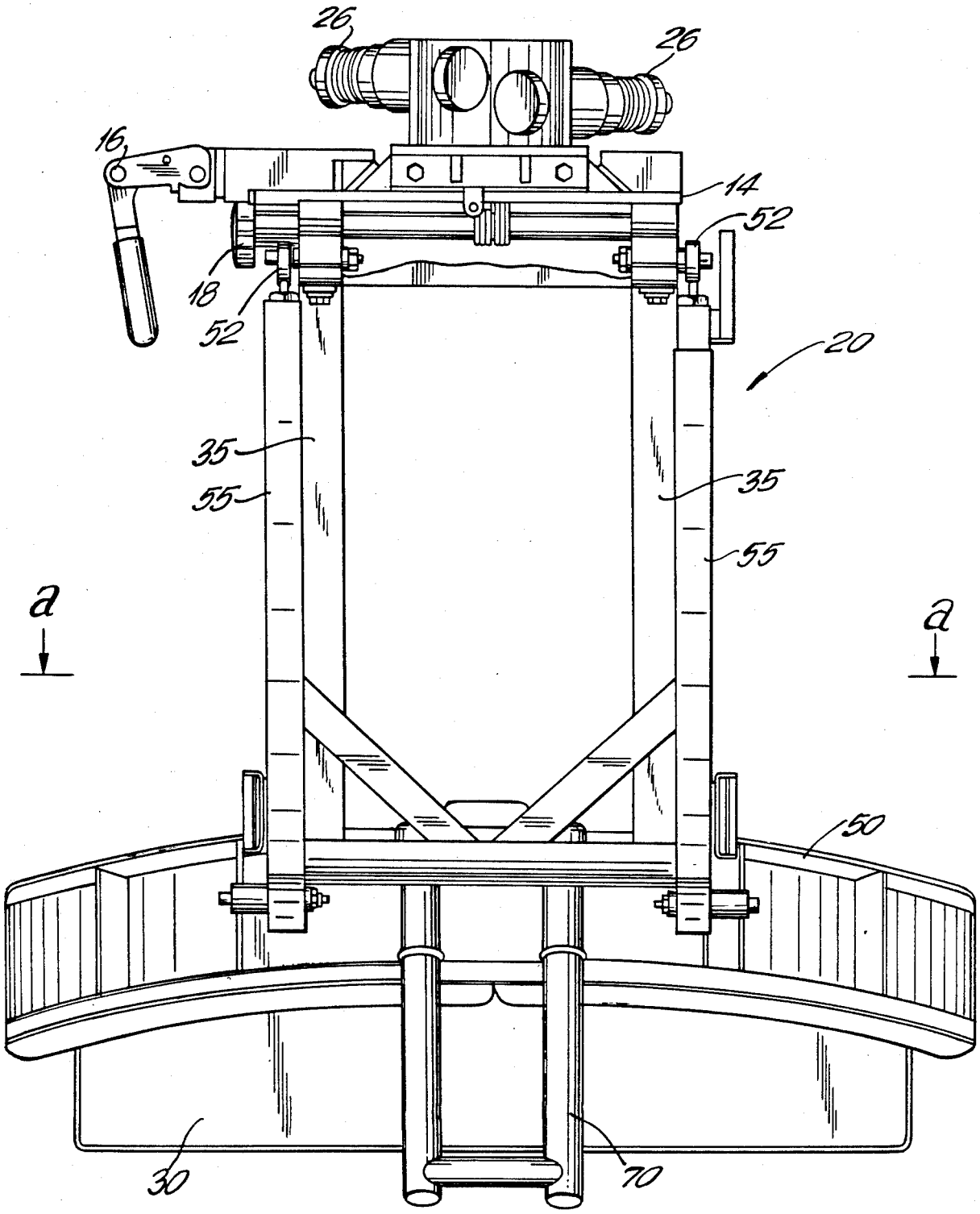
FIG. 3 is a front elevational view of the upper body rotation assembly of the present invention with the chest pad and the front support structure in the lowered position.

As seen in FIGS. 3, 4 and 5, the chest pad 50 is attached to a front support structure 55. The front support structure 55 is attached to the top support structure 38 by hinge screws 52 as shown in FIGS. 3, 4 and 5. The hinge screws 52 permit the front support structure 55, with the attached chest pad 50, to swing up and down between the raised position (FIGS. 1 and 4) and the lowered position (FIGS. 2, 2A and 5). The front support structure 55 is counterbalanced by a gas spring 80 such that the front support structure 55 stays in the raised position (FIGS. 1 and 4) unless pulled down by the operator. The gas spring 80, which at one end is attached to the top support structure 38 and at the other end is attached to the front support structure 55, is of conventional construction and in the present embodiment is a model FE11P1-120 manufactured by the Gas Spring Corporation.

As the operator lowers the chest pad 50 from the raised position of FIGS. 1 and 4 to the lowered position of FIGS. 2, 2A and 5, the gas spring 80 goes "over center" causing the chest pad 50 to be held lightly against the chest of the patient. As is well understood by these skilled in the art, when the gas spring 80 goes over "center" the direction of the force exerted by the gas spring 80 is reversed and the chest pad 50 is held lightly against the chest of the patient.

With the chest pad 50 resting against the chest of the patient, the operator secures the chest pad 50 to the scapula pad 30 by inserting belts 90 into buckles 92. There is one belt 90 and one buckle 92 on each side of the rotation assembly 20. As shown in FIG. 5, one of the belts 90 is attached to the rear support structure 35, and one of the buckles 92 is attached to the front support structure 55. The other belt 90 and buckle 92 are similarly located on the other side of the rotation assembly 20. The belt 90 and the buckle 92 comprise a self-locking, uni-directional mechanism which allows movement of the chest pad 50 only in the direction of the scapula pad 30, i.e., only in the direction for securing the chest pad 50 to the scapula pad 30.

After the operator secures the chest pad 50 to the scapula pad 30 by use of belts 90 and buckles 92, the patient is fully secured in the machine 10, as shown in FIGS. 2 and 2A. The patient then rotates the rotation assembly 20 by exerting a rotational force against the scapula pad 30 and the chest pad 50. The force which the patient's lower back musculature is able to exert in rotation is measured by the dynamometer 40, as previously described.

The use of chest pad 50 and scapula pad 30 insures that the patient can be stabilized to the rotation assembly 20 in the same fashion any number of times. This reproduciblility of the test, rehabilitation or exercise conditions is valuable, especially in situations where it is important to monitor very closely the patient's progress or lack thereof over a specified time period. Further, use of the chest pad 50 and the scapula pad 30 does not cause any pain or discomfort to the patient, thus insuring that the patient will not inhibit his or her rotational movement in some way because of any such pain or discomfort.

Because the upper body of the patient is secured to the rotation assembly 20, and the lower body of the patient is secured by the lower body stabilization apparatus 300, the dynamometer 40 measures the rotational strength of the lower back musculature of the patient about a vertical axis without involvement in the rotation of muscle groups other than those muscles in the lower back. Without suitable upper and lower body stabilization, this isolated measurement of the patient's lower back musculature rotational strength would not be possible because other muscle groups, such as in the pelvic area, legs, shoulders and arms, would be involved in the motion, making it virtually impossible to measure the rotational strength only of the lower back muscles.

Two hydraulic shock absorbers 26, which are attached to the slide assembly 14, prevent the patient from rotating the rotation assembly 20 beyond a certain point in each direction of motion. This prevents damage to the machine and also prevents injury to the patient because of a sudden halt to rotational movement. Adjustable mechanical stops (not shown) located on the frame 60 of the machine 10 are used in conjunction with the shock absorbers 26 to limit the range of motion. The mechanical stops are independently adjustable for left and right rotation, allowing rotation to be equal either side of center of the machine 10 or unequal (more rotation to one side of center than the other) if desired.

Limiting the range of motion of the rotation assembly 20 is important in that when the patient attempts to rotate the rotation assembly 20 beyond the patient's natural range of motion, injury to the patient can result. Also, limiting the range of motion of the rotation assembly 20 provides consistent starting and stopping points for the rotation, enhancing the accuracy and consistency of the measurements of the strength of the lower back musculature in rotation.

The rotation assembly 20 of the present invention is shown in detail in FIGS. 3, 4, 5, 6 and 7.

Figure 6:
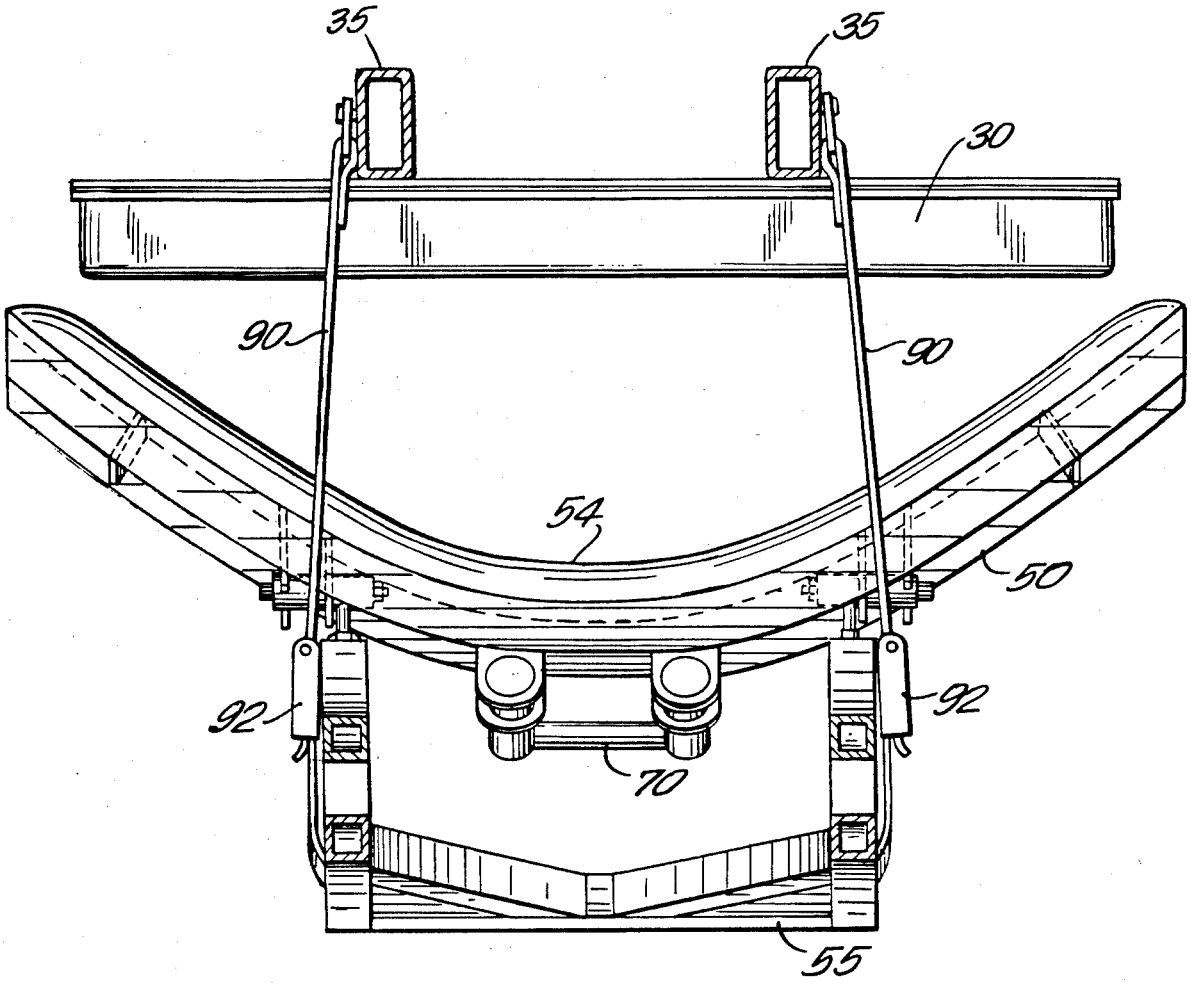
FIG. 6 is a top view of the upper body rotation assembly along lines a—a of FIG. 3.
Figure 7:
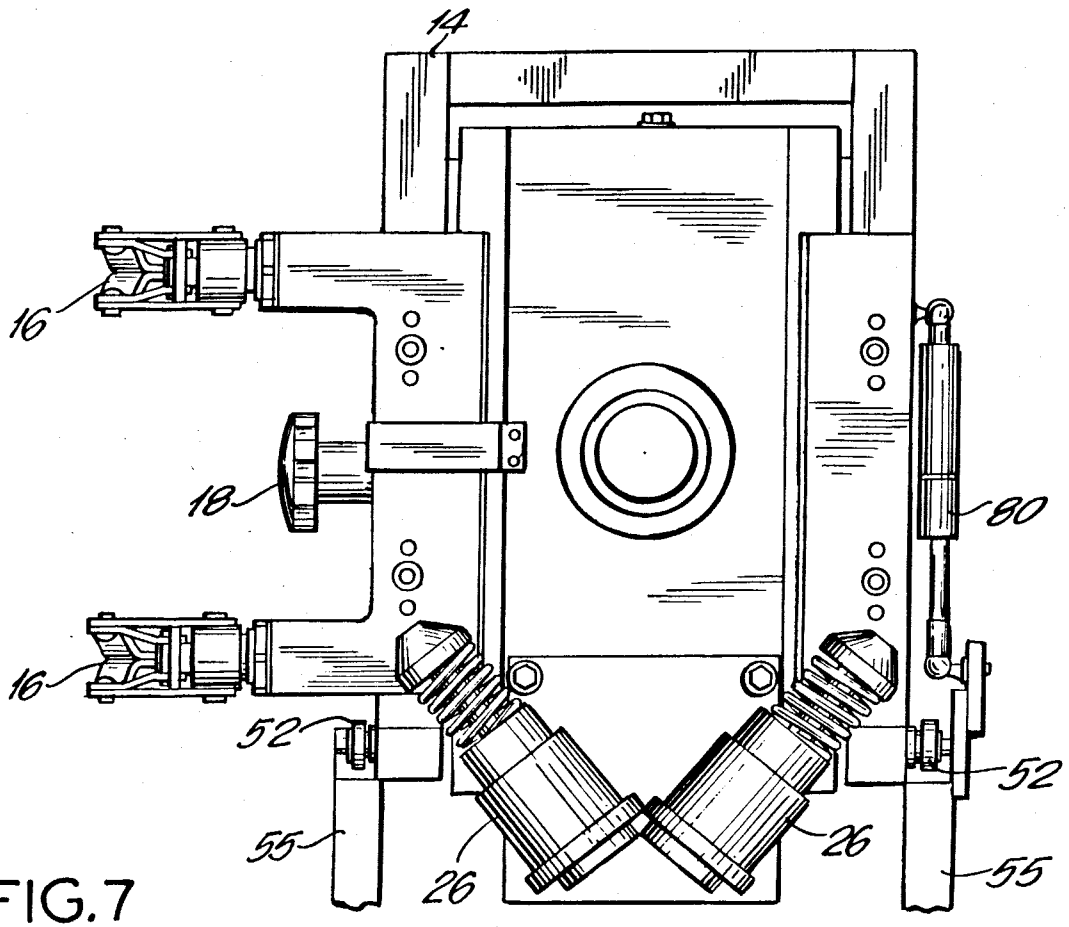
FIG. 7 is a partial top view of the upper body rotation assembly of FIG. 3.

The chest pad 50 is curved as shown in FIG. 6. The curve of the chest pad 50 is designed to fit the greatest variety of upper body shapes and sizes, providing the greatest comfort and stabilization to the largest portion of the population possible. This design evenly distributes the force due to rotation as the patient attempts to rotate against the chest pad 50 and the scapula pad 30, and maximizes the comfort for the patient during the test, rehabilitation or exercise procedure. Also, the curvature of the chest pad 50 permits the patient to be easily centered in the machine 10.

During the test, rehabilitation or exercise procedure, the patient grasps the handle 70. The handle 70 is attached to the chest pad 50, as shown in FIGS. 3, 4 and 5. Grasping the handle 70 prevents extraneous arm movement as the patient attempts to rotate his lower back. It is important to stabilize the arms against extraneous movement because otherwise such extraneous movement interferes with the isolated testing of the lower back musculature in rotation about a vertical axis.

The rotation assembly 20, in the present embodiment, except for a cushion portion 54 of the chest pad 50 and the scapula pad 30, is made primarily from aluminum and thin wall steel tubing. This combination of materials maximizes stiffness and also minimizes the mass moment of inertia for the entire rotation assembly 20. It is important to have a low mass moment of inertia for the rotation assembly 20 because the lower the mass moment of inertia, the less energy required by the patient to accelerate the rotation assembly 20 by exertion of a rotational force against the scapula pad 30 and the chest pad 50. The less energy required by the patient to rotate the rotation assembly 20, the more accurate is the force measurement made by dynamometer 40 because any energy expended by the patient in attempting to overcome the inertia of the rotation assembly 20 is not measured by the dynamometer 40 since the dynamometer will not measure any force exerted by the patient until the patient accelerates the rotation assembly 20 to the pre-determined speed.

It is to be understood that the rotation assembly 20 of the present invention could be used on a machine for testing of the lower back musculature rotational strength of persons other than in a medical or rehabilitation setting. For example, the back test, rehabilitation and exercise machine may used for industrial screening of potential employees in order to analyze if such persons have the lower back musculature rotational strength and range of motion necessary for certain job functions.

Also, the rotation assembly 20 of the present invention could be used on an exercise machine designed for the exercise of a person's lower back musculature in rotation about a vertical axis without involvement in the exercise of muscles other than in the lower back.

Applicant's invention is not limited to the embodiment of the upper body rotation assembly described above, but it is understood that applicant's invention is as set forth in the following claims.

I claim:

1. An upper body rotation assembly for a back test, rehabilitation and exercise machine designed for the isolated testing, rehabilitation and exercise of the lower back musculature of a person comprising:

a front support structure having a top end attached to a top support structure of the frame of the machine;

a rear support structure having a top end attached to the top support structure of the frame of the machine;

a chest pad bearing against the chest of the person, said chest pad attached to a bottom end of the front support structure;

a scapula pad bearing against the scapula of the person, said scapula pad attached to a bottom end of the rear support structure;

means for securing the chest pad to the scapula pad;

means for attaching the top support structure to the frame of the machine wherein when the person exerts a rotational force against the chest pad and the scapula pad, the rotation assembly rotates relative to a vertical axis of the machine; and means for rotating the chest pad upwardly away from the scapula pad so that the person may easily enter or exit from the rotation assembly, said means for rotating comprising a hinged connection between the top end of the front support structure and the top support structure.

2. The rotation assembly of claim 1 wherein the chest pad is continuously curved and the curve of the chest pad is designed to fit the greatest variety of upper body shapes and sizes, providing the greatest comfort and stabilization to the largest portion of the population possible.

3. The rotation assembly of claim 1 wherein the means for securing the chest pad to the scapula pad comprises at least two belts, one on each side of the rotation assembly.

4. The rotation assembly of claim 1 also comprising means for aligning a natural anatomical axis of the upper body of the person with a vertical axis of rotation of the rotation assembly wherein the rotation assembly is moved backward or forward to perform the alignment.

5. The rotation assembly of claim 1 wherein a handle is attached to a bottom end of the chest pad.

6. The rotation assembly of claim 1 wherein the rotation assembly, except for a cushion portion of the chest pad and the scapula pad, is made primarily of aluminum and thin wall steel tubing.

7. The rotation assembly of claim 1 also comprising means for limiting the range of motion which the person may rotate the rotation assembly without damaging the assembly, said means comprising in combination adjustable mechanical stops attached to the frame and hydraulic shock absorbers attached to the rotation assembly.

8. An upper body rotation assembly for a back test, rehabilitation and exercise machine designed for the isolated testing, rehabilitation and exercise of the lower back musculature of a person comprising:

a front support structure having a top end attached to a top support structure of the frame of the machine;

a rear support structure having a top end attached to the top support structure of the frame of the machine;

a chest pad bearing against the chest of the person, said chest pad attached to a bottom end of the front support structure;

a scapula pad bearing against the scapula of the person, said scapula pad attached to a bottom end of the rear support structure;

a slide assembly attached to the top support structure wherein the top support structure may slide forward or backward in the slide assembly;

means for attaching the slide assembly to the frame of the machine wherein when the person exerts a rotational force against the chest pad and the scapula pad, the rotation assembly rotates relative to a vertical axis of the machine;

means for locking the top support structure in the slide assembly so that the top support structure may not slide forward or backward in the slide assembly when the locking means are locked;

means for securing the chest pad to the scapula pad;

means for rotating the chest pad upwardly away from the scapula pad so that a person may easily enter or exit from the rotation assembly, said means for rotating comprising a hinged connection between the top end of the front support structure and the top support structure; and means for assisting the rotation of the chest pad.

9. The rotation assembly of claim 8 wherein the chest pad is continuously curved and the curve of the chest pad is designed to fit the greatest variety of upper body shapes and sizes, providing the greatest comfort and stabilization to the largest portion of the population possible.

10. The rotation assembly of claim 8 wherein the means for securing the chest pad to the scapula pad comprises at least two belts, one on each side of the rotation assembly.

11. The rotation assembly of claim 8 wherein a handle is attached to a bottom end of the chest pad.

12. The rotation assembly of claim 8 wherein the rotation assembly, except for a cushion portion of the chest pad and the scapula pad, is made primarily of aluminum and thin wall steel tubing.

13. The rotation assembly of claim 8 also comprising means for limiting the range of motion which the person may rotate the rotation assembly without damaging the assembly, said means comprising in combination adjustable mechanical stops attached to the frame and hydraulic shock absorbers attached to the rotation assembly.

14. The rotation assembly of claim 8 also comprising a bracket mounted on the frame of the machine wherein an operator of the machine aligns a vertical axis of rotation of the rotation assembly with the natural anatomical axis of the upper body of the person by sliding the top support structure in the slide assembly until the vertical line of the bracket is visually aligned with the sagittal midline plane of the person.

15. The rotation assembly of claim 14 also comprising a knob attached to the top support assembly wherein the operator turns the knob in order to slide the top support structure in the slide assembly.

16. The rotation assembly of claim 8 wherein the means for locking the top support structure to the slide assembly comprises at least one toggle clamp.

17. An upper body rotation assembly for a back test, rehabilitation and exercise machine designed for the isolated testing, rehabilitation and exercise of the lower back musculature of a person in rotation about a vertical axis comprising:

a chest pad bearing against the chest of the person;

a scapula pad bearing against the scapula of the person;

a rear support structure attached to the scapula pad;

a front support structure attached to the chest pad;

a top support structure attached to the rear support structure and the front support structure;

a slide assembly attached to the top support structure wherein the top support structure may slide forward or backward in the slide assembly;

means for attaching the slide assembly to the frame of the machine wherein the person may exert a rotational force against the chest pad and the scapula pad rotates relative to a vertical axis of the machine and cause the rotation assembly to rotate relative to the frame of the machine;

means for locking the top support structure in the slide assembly so that the top support structure may not slide forward or backward in the slide assembly when the locking means are locked;

means for securing the chest pad to the scapula pad;

means for raising and lowering the chest pad so that a person may easily enter or exit from the rotation assembly; and means for assisting the raising and lowering of the chest pad, said means for assisting comprising a gas spring attached at one end to the top support structure and attached a the other end to the front support structure.

* * * * *